US007389227B2

(12) United States Patent
Kang et al.

(10) Patent No.: US 7,389,227 B2
(45) Date of Patent: Jun. 17, 2008

(54) HIGH-SPEED SEARCH METHOD FOR LSP QUANTIZER USING SPLIT VQ AND FIXED CODEBOOK OF G.729 SPEECH ENCODER

(75) Inventors: Sang Won Kang, Kyung Ki-do (KR); Chang Yong Son, Seoul (KR); Won Il Lee, Kyung Ki-do (KR); Yoo Na Sung, Seoul (KR); Min Kyu Shim, Seoul (KR); Seong Hoon Hong, Seoul (KR)

(73) Assignee: C & S Technology Co., Ltd., Seoul (KR)

( * ) Notice: Subject to any disclaimer, the term of this patent is extended or adjusted under 35 U.S.C. 154(b) by 767 days.

(21) Appl. No.: 09/749,782

(22) Filed: Dec. 28, 2000

(65) Prior Publication Data

US 2001/0010038 A1 Jul. 26, 2001

(30) Foreign Application Priority Data

Jan. 14, 2000 (KR) ..... 2000-1756
Feb. 25, 2000 (KR) ..... 2000-9519
Apr. 11, 2000 (KR) ..... 2000-18838

(51) Int. Cl.
*G10L 19/12* (2006.01)

(52) U.S. Cl. ..... 704/222; 704/223

(58) Field of Classification Search ..... 704/221–223
See application file for complete search history.

(56) References Cited

U.S. PATENT DOCUMENTS 4,907,276 A * 3/1990 Aldersberg ..... 704/222
5,061,924 A * 10/1991 Mailhot ..... 341/76
5,194,864 A * 3/1993 Nakano ..... 341/106
5,481,739 A * 1/1996 Staats ..... 712/222
5,748,839 A * 5/1998 Serizawa ..... 704/222
6,246,979 B1 * 6/2001 Carl ..... 704/219
6,622,120 B1 * 9/2003 Yoon et al. ..... 704/222
6,836,225 B2 * 12/2004 Lee et al. ..... 341/50

FOREIGN PATENT DOCUMENTS

EP 0 505 654 A1 * 9/1992

OTHER PUBLICATIONS

Paliwal, K. K., and V. Ramasubramanian, "Effect of Ordering the Codebook on the Efficiency of the Partial Distance Search Algorithm for Vector Quantization," IEEE Trans. Commun., vol. 37, pp. 538-540, May 1989□□.*

* cited by examiner

*Primary Examiner*—Donald L. Storm
(74) *Attorney, Agent, or Firm*—Bacon & Thomas, PLLC

(57) ABSTRACT

A high-speed search method in a speech encoder using an order character of LSP (Line Spectrum Pair) parameters in an LSP parameter quantizer using SVQ (Split Vector Quantization) used in a low-speed transmission speech encoder, includes the steps of rearranging a codebook according to an element value of a reference row for determining a range of code vectors to be searched; and determining a search range by using an order character between a given target vector and an arranged code vector to obtain an optimal code vector. The method gives effects of reducing computational complexity required to search the codebook without signal distortion in quantizing the LSP parameters of the speech encoder using SVQ, and reducing computational complexity without loss of tone quality in G.729 fixed codebook search by performing candidate selection and search on the basis of the correlation value size of the pulse position index.

3 Claims, 5 Drawing Sheets

HIGH-SPEED SEARCH METHOD FOR LSP QUANTIZER USING SPLIT VQ AND FIXED CODEBOOK OF G.729 SPEECH ENCODER

BACKGROUND OF THE INVENTION

1. Technical Field

The present invention relates to a high-speed search method for an LSP (Local Spectrum Pair) using SVQ (Split Vector Quantization) and a fixed codebook of the G.729 speech encoder, and more particularly to a high-speed search method which may decrease overall computational complexity without sacrificing spectral distortion performance by reducing a size of the codebook using an order character of LSP parameters in searching a codebook having high computational complexity during quantizing a split vector of LSP parameters of a speech encoder, used to compress voice signals in a low speed, and a high-speed search method which may dramatically reduce computational complexity without loss of tone quality by detecting and searching tracks on the basis of a magnitude order of a correlation signal (d'(n)), obtained by an impulse response and a target signal in the process of searching the fixed codebook of the G.729 speech encoder.

2. Description of the Prior Art

Generally, for the speech encoding in a less than 16 kbps transmission rate, the speech is not directly transmitted but parameters representing the speech are sampled and quantized to reduce magnitude of the data, in a circumstance that the bandwidth is limited.

For high-quality encoding, the low transmission speech encoder quantizes LPC coefficients, in which an optimal LPC coefficient is obtained by dividing the input speech signal in a frame unit to minimize predictive error energy in each frame.

LPC filter is commonly a $10^{th}$ ALL-POLE filter.

In the above conventional method, more bits should be assigned to quantize the 10 LPC coefficients. However, when directly quantizing the LPC coefficients, there are problems that characters of the filters are very sensitive to the quantization error and that stability of the LPC filter is not assured after quantizing the coefficients.

SUMMARY OF THE INVENTION

Therefore, the present invention is designed to overcome the problems of the prior art. An object of the present invention is to provide a high speed search method for a speech encoder having decreased overall computational complexity, and in which spectral distortion performance is not sacrificed.

BRIEF DESCRIPTION OF THE DRAWINGS

These and other features, aspects, and advantages of the present invention will become better understood with regard to the following description, appended claims, and accompanying drawings, in which like components are referred to by like reference numerals. In the drawings:

DETAILED DESCRIPTION OF THE PREFERRED EMBODIMENT

Hereinafter, preferred embodiments of the present invention will be described in detail with reference to the accompanying drawings.

Quantizing overall vectors at one time is substantially impossible because a size of the vector table becomes too big and too much time is taken for search. To solve this problem, the present invention employs SVQ (Split Vector Quantization) to divide overall vectors into several sub-vectors and then quantize the sub-vectors independently. A predictive SVQ, which is a method adding a prediction unit to the SVQ, uses correlation between frames of the LSP (Linear Spectrum Pair) parameters for more efficient quantization. That is, the predictive SVQ does not quantize the LSP of a current frame directly, but predicts the LSP of the current frame on the basis of an LSP of the previous frame and then quantizes a prediction error. The LSP has a close relation with a frequency character of the speech signal, making time prediction possible with great gains.

When quantizing the LSP parameters with such VQ, most of quantizers have a large LSP codebook. And, in order to reduce computational complexity in searching an optimal code vector in the codebook, the quantizer decreases a range of codes to be searched by using an order of the LSP parameters. That is, the quantizer arranges the code vectors in the codebook for a target vector in a descending order according to element values in a specific position in a sub-vector. Then, the optimal code vector, which minimizes distortion in the arranged codebook, has nearly identical value with that of the target vector, which implies that such value has an order character. Under such presumption, the present invention compares an element value of a specific position arranged in a descending order with element values of other adjacent positions, and then calculates distortion with high computational complexity for the code vectors, which satisfies the order character, and cancels the calculation process for other code vectors.

Such method may reduce a great amount of computational complexity, overall.

Figure 1:
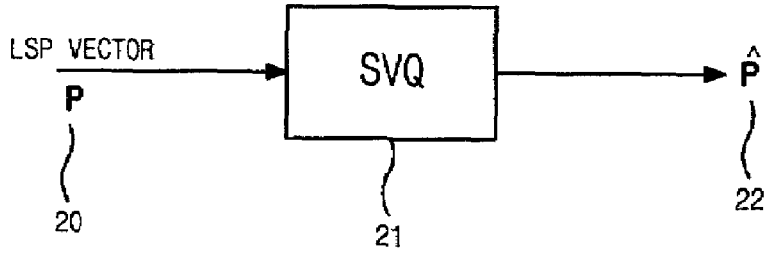
FIG. 1 is a block diagram for illustrating a general SVQ (Split Vector Quantization)

FIG. 1 shows a structure of a general SVQ. As shown in the figure, the target vector, or LSP vector (p) satisfies the below order character.

$$0<p_1<p_2<\ldots<p_p<\pi \qquad \text{[Equation 1]}$$

$$E_{1,m} = (p_m - p\}_{1,m})^T W_m (p_m - p\}_{1,m}) \qquad \text{[Equation 2]}$$

$$0 \le m \le M-1$$

$$1 \le l \le L_m$$

where l,m in the subscript of $E_{l,m}$ are indices that represent the lth index of the mth codebook, i.e., the letters "l" and "m," and where superscript T designates the transpose of $(p_m-p\}_{l,m}\}$ for purposes of determining the dot product of $(p_m-p\}_{l,m}\}$ and $W_m$ $(p_m-p\}_{l,m}\}$ in order to calculate the least-mean-square error $E_{l,m}$.

In the Equation 2, the error criterion $E_{l,m}$ is represented as a formula of p and p}, in which $p_m$ is a target vector to search the $m^{th}$ codebook, and $p\}_{l,m}$ is corresponding to a $l^{th}$ code vector in a codebook for $m^{th}$ sub-vector. Here, an optimal code vector for each sub-vector is selected to minimize the next error criterion $E_{l,m}$ and then transmitted through a finally selected codebook index (l)

In the Equation 2, the LSP code vector (p}) is divided into M number of sub-vectors, each of which consists Of $L_m$ number of code vectors. Codebook magnitudes ($L_0, L_1, \ldots, L_{M-1}$) of M number may be assigned to a specific sub-vector to improve tone quality. $W_m$ is a weighting matrix for the $m^{th}$ sub-vector and obtained by a non-quantized LSP vector (p).

Figure 3:
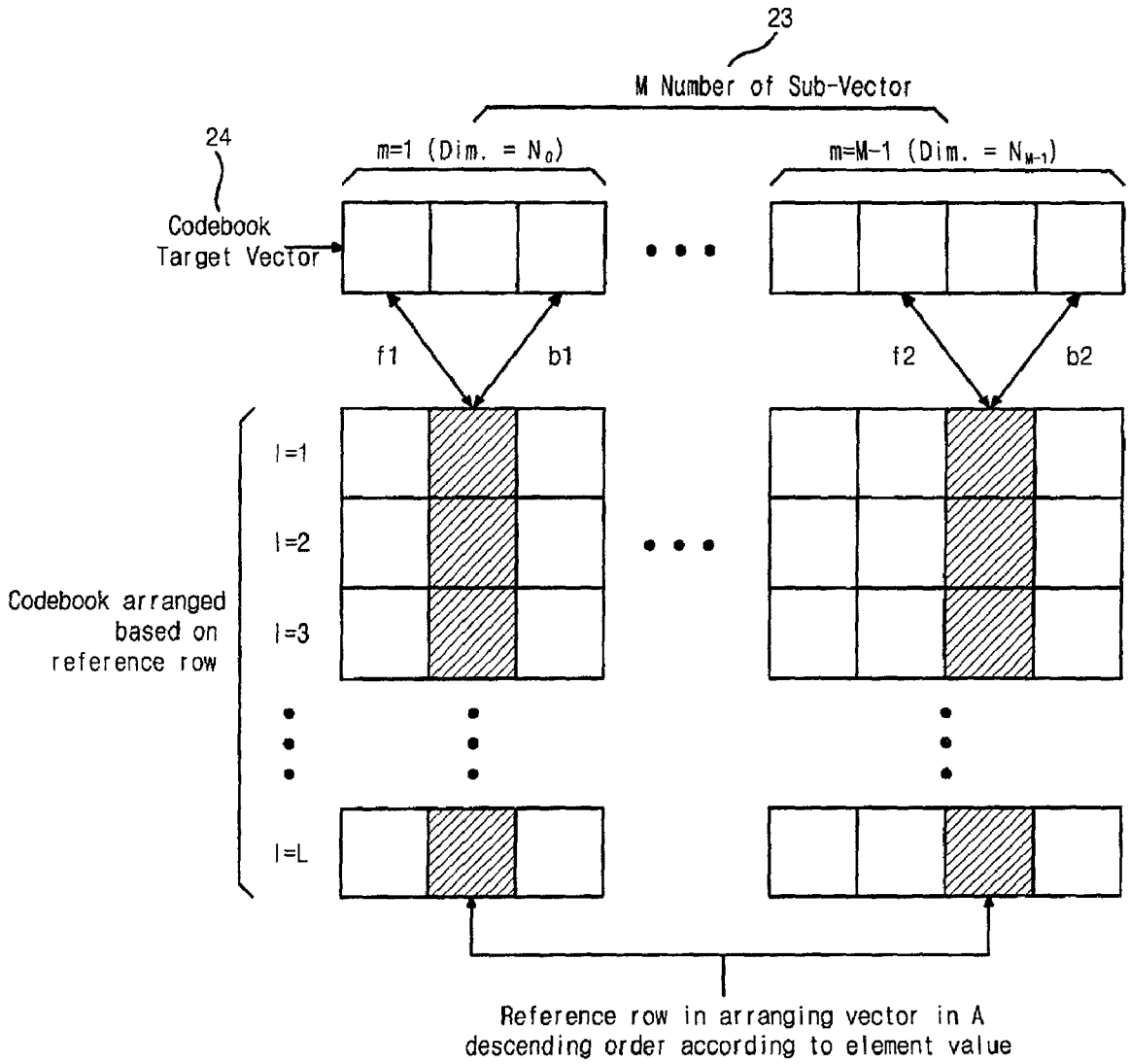
FIG. 3 shows a high-speed search method in a LSP quantizer according to the present invention.

In order to employ a high-speed search method in the present invention, conversion of the conventional codebook is needed. This is a process of replacing the conventional codebook with a new codebook having L reference rows, as illustrated in FIG. 3, which is arranged in a descending order on the basis of a specific row (or, reference row), experimentally determined. The reference row is selected for each codebook and should be a row in which an average search range is minimized experimentally. The average search range is an average number with which an element value of the $n^{th}$ row in the arranged codebook based on each $n^{th}$ row and an element value of $n+1^{th}$ and $n-1^{th}$ positions in the target vector satisfy the order character with use of the target vector for the arranged codebook.

$$p\}_{1,n} > p\}_{n-1}, \quad 1 \le l \le L \quad 0 \le n \le 8 \qquad \text{[Equation 3]}$$

$$p\}_{1,n} > p\}_{n+1}, \quad 1 \le l \le L, \quad 1 \le n \le 9$$

where l,n in the subscript of $p_{l,n}$ are indices that represent the lth index of the nth reference row. i.e.. the letters "l" and "n."

As seen in the Equation 3, the element value of the $n-1^{th}$ row in the target vector should be less than the element value of the $n^{th}$ row in the codebook, while the element value of the $n+1^{th}$ row should be bigger than the element value of the $n^{th}$ row in the codebook.

Presuming that the reference row of each codebook, which is optimized to each codebook, is $N_0, N_1, \ldots, N_m$ and the $10^{th}$ LSP vector is a target vector, a search range of the codebook is determined by comparing the element value of the reference row in the codebook to be searched using the following Equations 4 and 5 with element values of rows before and after the reference row in the target vector and then excluding code vectors, which are not satisfying the order character, from the searching process.

$$(p_{N-1} > p\})_{1,N}, \quad 1 \le l \le L, \quad 1 \le N \le 9 \qquad \text{[Equation 4]}$$

$$(p_{N+1} > p\})_{1,N}, \quad 1 \le l \le L, \quad 0 \le N \le 8 \qquad \text{[Equation 5]}$$

In this specification, comparing an element value of $N^{th}$ row of a code vector with an element value of a $N-1^{th}$ row of a target vector as shown in the Equation 4 to determining whether they satisfy the order character is called as a forward comparison, comparing the element value of the $N^{th}$ row of the code vector with an element value of a $N+1^{th}$ row of the target vector as shown in the Equation 5 to determining whether they satisfy the order character is called as a backward comparison.

Hereinafter, preferred embodiments of the present invention are explained with reference to the accompanying drawings.

Figure 2:
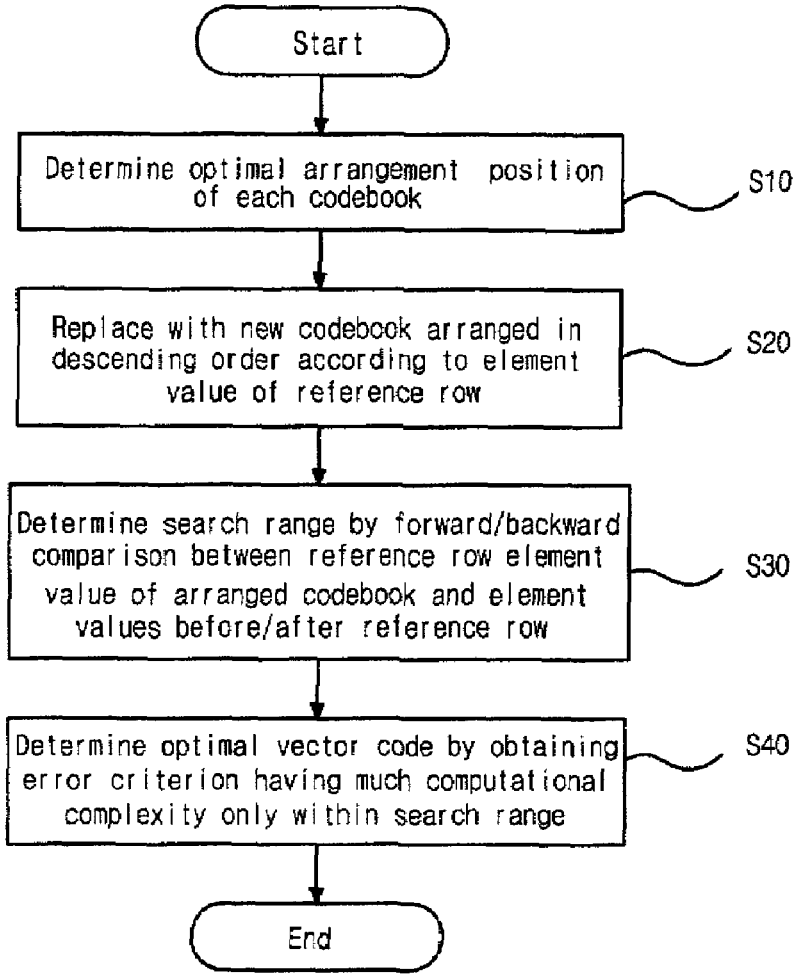
FIG. 2 is a flowchart for illustrating how to determining a code vector in a LSP (Line Spectrum Pair) quantizer used in a low transmission speech encoder according to the present invention.

FIG. 2 is a flowchart for illustrating the process of determining a code vector in the LSP quantizer, used in the low transmission speech encoder, according to the present invention. As shown in the figure, the process includes the steps of experimentally determining an optimal arrangement position for each codebook by using various speech data S10 replacing the codebook, in which a predetermined number of code vectors are arranged, with a new codebook, which is arranged in a descending order according to an element value of a determined reference row S20, determining a search range by forward and backward comparison of the element value of the arranged codebook and element values before and after a corresponding row of the target vector according to a predetermined flowchart S30, and determining an optimal code vector by obtaining an error criterion only within the predetermined search range S40.

FIG. 3 shows a high-speed search method in the LSP quantizer according to the present invention. As shown in the figure, f1, f2 and b1, b2 indicate element values of the code vector and the target vector used in the forward and backward comparison, respectively. Here, because each codebook is arranged in a descending order, if obtaining a start point satisfying the order character in the forward comparison, other element values become automatically satisfying the forward order character. In the backward comparison, what is only have to do is to obtain an end point, which satisfies the order character.

The process of obtaining a substantial start point and an end point of a code vector group, satisfying the order character for the given target vector, is shown in FIG. 4.

Figure 4A:
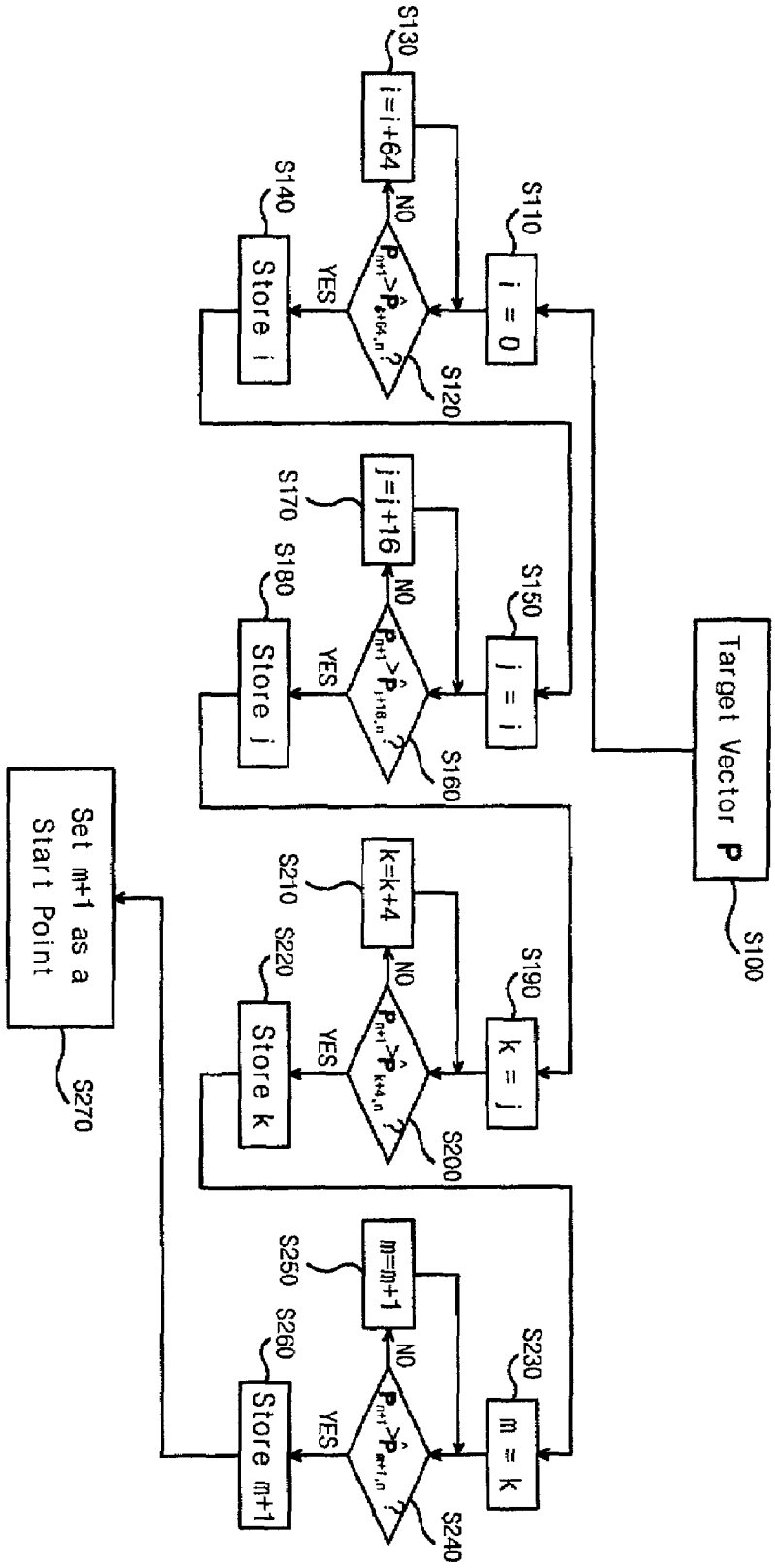
FIGS. 4*a* and 4*b* show a start point and an end point of a code vector group satisfying the order character, in which FIG. 4*a* and FIG. 4*b* shows a forward comparison and a backward comparison, respectively.
Figure 4B:
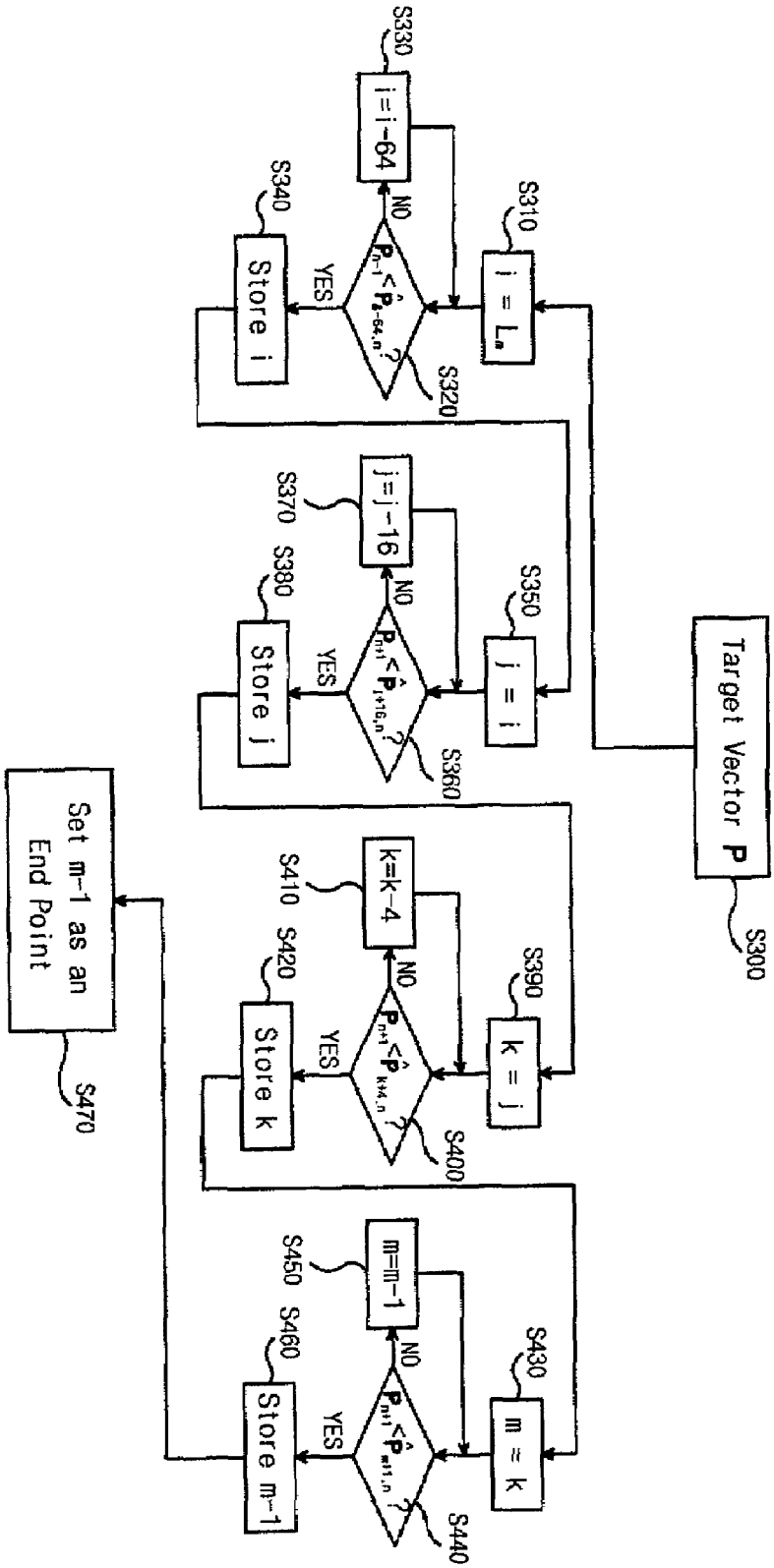

FIGS. 4*a* and 4*b* are flowcharts for illustrating the process of obtaining a substantial start point and an end point of a code vector group, which satisfies the order character, for the forward and backward comparison, respectively. The search range of the codebook can be calculated with the start point and the end point, obtained by such flowcharts.

As shown in FIG. 4*a*, the process of obtaining a codebook search start point includes the steps of calculating a LSP vector (p) S100, initializing a variable i into 0 (zero) S110, comparing a size of $p_{n+1}$ with a size of $p\}_{i+64,n}$ S120, increasing the variable i as much as 64 if the size of $p_{n+1}$ is smaller than the size of $p\}_{i+64,n}$ S130, storing the variable i if the size of $p_{n+1}$ is bigger than the size of $p\}_{i+64,n}$ S140, initializing a variable j into the stored variable i S150, comparing a size of $p_{n+1}$ with a size of $p\}_{j+16,n}$ S160, increase the variable j as much as 16 if the size of $p_{n+1}$ is smaller than the size of $p\}_{j+16,n}$ S170, storing the variable j if the size of $p_{n+1}$ is bigger than the size of $p\}_{j+16,n}$ S180, initializing a variable k into the stored variable j S190, comparing a size of $p_{n+1}$ with a size of $p\}_{k+4,n}$ S200, increasing the variable k as much as 4 if the size of $p_{n+1}$ is smaller than the size of $p\}_{k+4,n}$ S210, storing the variable k if the size of $p_{n+1}$ is bigger than the size of $p\}_{k+4,n}$ S220, initializing a variable m into the stored variable k S230, comparing a size of $p_{n+1}$ with a size of $p\}_{m+1,n}$ S240, increasing the variable m as much as 1 if the size of $p_{n+1}$ is smaller than the size of $p\}_{m+1,n}$ S250, storing the variable m+1 if the size of $p_{n+1}$ is bigger than the size of $p\}_{m+1,n}$ S260, and setting the calculated variable m+1 as a start point S270.

As shown in FIG. 4*b*, the process of setting a codebook search end point includes the steps of calculating the LSP vector (p) S300, initializing a variable i into $L_m$ S310, comparing a size of $p_{n-1}$ with a size of $P\}_{i-64,\,n}$ S320, decreasing the variable i as much as 64 if the size of $p_{n-1}$ is bigger than the size of $p\}_{i-64,\,n}$ S330, storing the variable i if the size of $p_{n-1}$ is smaller than the size of $p\}_{i-64,\,n}$ S340, initializing a variable j into the stored variable i S350, comparing the size of $p_{n-i}$ with a size of $p\}_{j-16,\,n}$ S360, decreasing the variable j as much as 16 if the size of $p_{n-i}$ is bigger than the size of $p\}_{j-16,\,n}$ S370, storing the variable j if the size of $P_{n-i}$ is smaller than the size of $p\}_{j-16,n}$ S380, initializing a variable k into the stored variable j S390, comparing the size of $p_{n-i}$ with a size of $P\}_{k-4,\,n}$ S400, decreasing the variable k as much as 4 if the size of $p_{n-1}$ is bigger than the size of $p\}_{k-4,\,n}$ S410, storing the variable k if the size of $p_{n-1}$ is smaller than the size of $P\}_{k-4,\,n}$ S420, initializing a variable m into the stored variable k S430, comparing the size of $p_{n-1}$ with a size of $p\}_{m-1,\,n}$ S440, decreasing the variable m as much as 1 if the size of $p_{n-1}$ is bigger than the size of $p\}_{m-1,\,n}$ S450, storing the variable m−1 if the size of $p_{n-1}$ is smaller than the size of $p\}_{m-1,\,n}$ S460, and then setting the calculated variable m−1 as an end point S470.

If the start point and the end point are calculated, an optimally quantized vector may be selected by obtaining a distortion only for the vectors within the range between the start point and the end point.

An efficient search method of the fixed codebook is very important for high quality speech encoding in a low-transmission speech encoder. In the G.729 speech encoder, the fixed codebook is searched for each sub-frame, and 17-bit logarithmic codebook is used for the fixed codebook and an index of the searched codebook is transmitted. A Vector in each fixed codebook has 4 pulses. As shown in Table 1, each pulse has size of +1 or −1 in a designated position and is represented by the Formula 6.

$$c(n) = \sum_{i=0}^{3} s_i \delta(n - m_i) \quad n = 0, 1, \ldots, 39 \qquad \text{[Equation 6]}$$

in which c(n) is a fixed codebook vector, δ(n) is a unit pulse and $m_i$ is a position of the $i^{th}$ pulse.

An object signal x'(n) for search in the fixed codebook is obtained by eliminating a portion contributed by an adaptable codebook in an object signal x(n) used in a pitch search and may be represented like the following Formula 7.

$$x'(n) = x(n) - g_p y(n) \quad n = 0, 1, \ldots, 39 \qquad \text{[Equation 7]}$$

in which $g_p$ is a gain of the adaptable codebook, and y(n) is a vector of the adaptable codebook.

Assuming that a codebook vector of an index (k) is $C_k$, an optimal code vector is selected as a codebook vector, which maximizes the following Formula 8.

$$T_k = \frac{C_k^2}{E_k} = \frac{(d^t c_k)^2}{c_k^t \Phi c_k} \qquad \text{[Equation 8]}$$

in which d is a correlation vector between the object signal x'(n) and an impulse response h(n) of a composite filter, and Φ is a correlation matrix with h(n). That is, d and Φ are represented with the following Formulas 9 and 10.

$$d(n) = \sum_{t=n}^{39} x'(i) h(i - n) \quad i = 0, 1, \ldots, 39 \qquad \text{[Equation 9]}$$

$$\Phi(i, j) = \sum_{n=j}^{39} h(n - i) h(n - j) \qquad \text{[Equation 10]}$$

$$i = 0, 1, \ldots, 39;\ j = i, \ldots 39.$$

The codebook search is comprised of 4 loops, each of which determines a new pulse. The matrix $C_k$ that is squared in the numerator of Formula 8 is given by C in the following Formula 11, and the denominator in the Formula 8 is given as the following Formula 12 (in which $\phi(m_i,m_j)$ corresponds to Φ(i,j) of equation 10).

$$C = \sum_{i=0}^{3} s_i d(m_i) \qquad \text{[Equation 11]}$$

in which $m_i$ is a position of $i^{th}$ pulse, and $s_i$ is its sign $$E = \sum_{i=0}^{3} \phi(m_i, m_j) + 2 \sum_{i=0}^{2} \sum_{j=i+1}^{3} s_i, s_j \phi(m_i, m_j) \qquad \text{[Equation 12]}$$

In order to reduce the computational complexity in the codebook search, the following process is employed. A first, d(n) is decomposed into and absolute value d'(n)=| d(n) | and its sign. At this time, the sign value is previously determined for the available 40 pulse position in Table 1. And, the matrix Φ is modified into φ'(i,j)=sign[s(i)] sign[s(j)] φ(i,j), φ'(i,j)=0.5φ(i,j) in order to include the previously obtained sign value. Therefore, the Formula 11 may be represented as:

$$C = d'(m_0) + d'(m_1) + d'(m_2) + d'(m_3)$$

and the Formula 12 may be represented as:

$$\begin{aligned} \frac{E}{2} = {} & \phi'(m_0, m_0) + \phi'(m_1, m_1) + \phi'(m_2, m_2) + \\ & \phi'(m_0, m_1) + \phi'(m_0, m_2) + \phi'(m_0, m_3) + \\ & \phi'(m_1, m_2) + \phi'(m_1, m_3) + \phi'(m_2, m_3) \end{aligned}$$

In order to search all available pulse positions, $2^{13}$ (=8,192) compositions should be searched. However, in order to reduce computational complexity, a threshold value ($C_{th}$) is determined as a candidate for searching 16 available pulses in a final track ($t_3$) and then a part of candidates having low possibility are excluded on the basis of experimental data among all of $2^9$ (=512) compositions to search pulses in the track ($t_3$) only for the candidates which are over the threshold value.

At this time, the threshold value ($C_{th}$) is determined with a function of a maximum correlation value and an average correlation value of the prior three tracks ($t_0$, $t_1$, $t_2$). The maximum correlation value of the tracks ($t_0$, $t_1$, $t_2$) can be expressed as the following Formula 13.

$$C_{max}=\max[d'(t_0)]+\max[d'(t_1)]+\max[d'(t_2)] \quad \text{[Equation 13]}$$

in which max[d'($t_i$)] is a maximum value of d'(n) in the three tracks ($t_0$, $t_1$, $t_2$). And, the average correlation value based on the tracks ($t_0$, $t_1$, $t_2$) is as follows.

$$C_{av}=\frac{1}{8}\left[\sum_{n=0}^{7} d'(5n)+\sum_{n=0}^{7} d'(5n+1)+\sum_{n=0}^{7} d'(5n+2)\right] \quad \text{[Equation 14]}$$

Here, the threshold value is given as the following Formula 15.

$$C_{th}=C_{av}+(C_{max}-C_{av})\alpha_t \quad \text{[Equation 15]}$$

The threshold value is determined before searching the fixed codebook. And, candidates only over the threshold value are subject to search of the final track ($t_3$). Here, the value of $\alpha_t$ is used to control the number of candidates to search the final track ($t_3$), in which the number of all candidates (N=512) becomes average N=60, and only 5% are over N=90. In addition, the track ($t_3$) is limited to $N_1$=105, and the number of the maximum candidates is limited to 180−$N_1$. At this time, among 8,192 compositions, 90×16=1440 number of searches are accomplished.

When searching the fixed codebook in the above process, most of the computations are required in searching a position index of the optimal pulse in a loop of each track. Therefore, the high-speed search method of the present invention arranges values of each d'(n) in the tracks ($t_0$, $t_1$, $t_2$) and then searches a position index which has the biggest d'(n) value among the three loops. Tables 2 and 3 show examples of the high-speed search method, including a search for specific sub-frames, which follow the below methods.

At first, the position indexes of the tracks ($t_0$, $t_1$, $t_2$) are arranged in a descending order according to the d'(n) value. Then, the position index that has the biggest probability to be an optimal pulse position. as shown in FIG. 4, is searched first. Because the numerator of the Formula 8 based on the d'(n) value is in a square type, its attribution is more than that of the denominator. A pulse position, which maximizes the correlation value ($C_k$), has great possibilities to be an optimal pulse position. This can be easily understood from Table 4, which statistically shows probability to be selected as an optimal position for each pulse in the fixed codebook, arranged in a descending order according to the d'(n) value. In other words, a pulse position having the biggest d'(n) value is most probably an optimal pulse position.

Then, because the threshold value in the Formula 15 is composed of only the d'(n) values. i.e.. the correlation vectors between the object signals and impulse response of the composite signals for each of the tracks ($t_0$, $t_1$, $t_2$). as described above, and arranged with the d'(n) values in a descending order, after calculating each d'(n) value of the tracks ($t_0$, $t_1$, $t_2$) and then determining whether the sum of the d'(n) values is over the predetermined threshold value, the search process is executed if the sum is over the threshold value by the codebook search is finished if the sum is not over the threshold value.

As described above, the candidate values over the threshold may be searched in a high-speed by sequentially arranging the fixed codebook according to the d'(n) values and calculating the correlation value $C_k$ on the basis of the arranged codebook.

Figure 5:
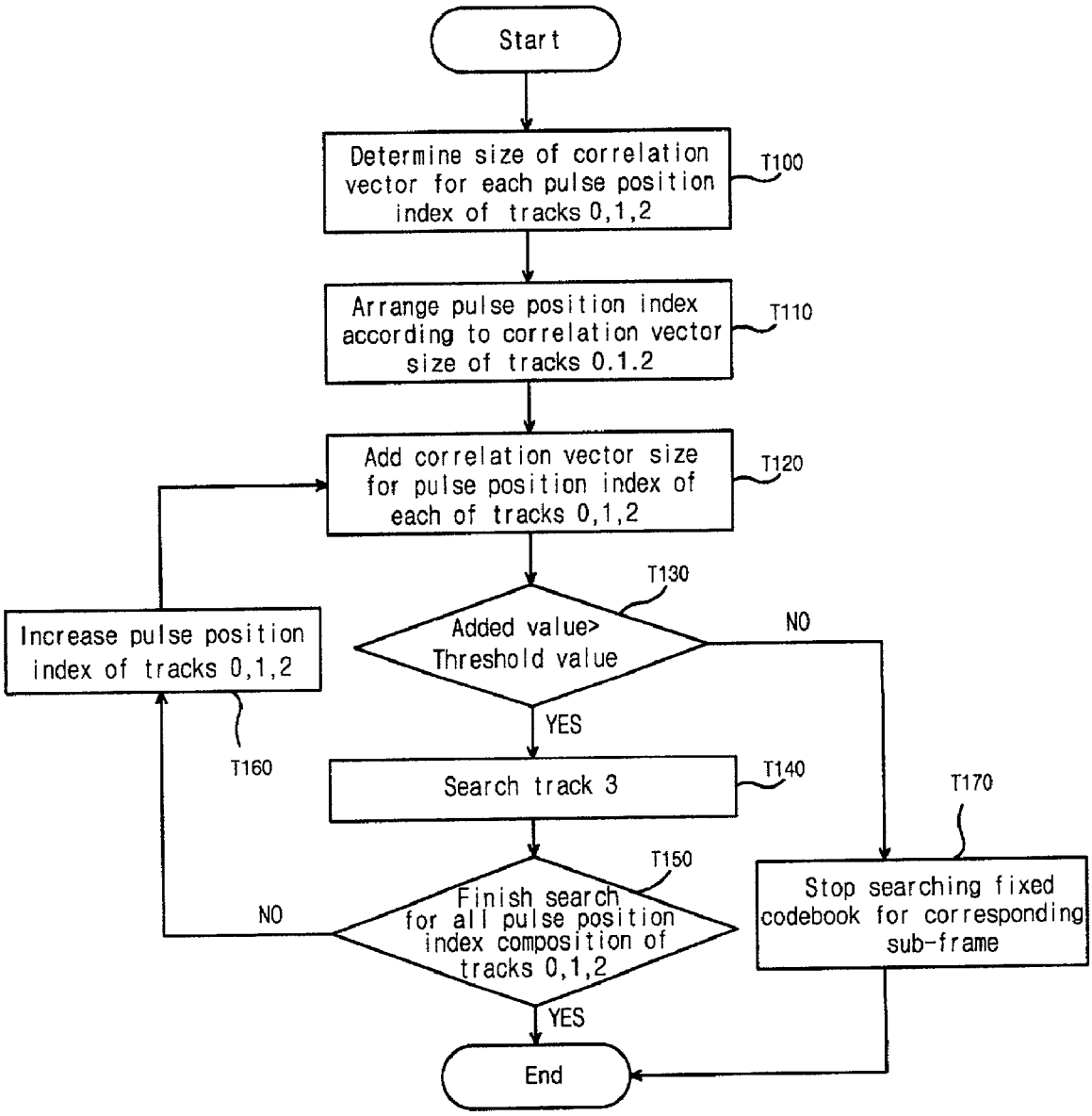
FIG. 5 shows a fixed codebook search method according to the present invention.

FIG. 5 shows the fixed codebook search method according to the present invention. As shown in the figure, the fixed codebook search method includes the steps of determining a correlation value for each pulse position index of the tracks ($t_0$, $t_1$, $t_2$) T100, arranging the pulse position indexes of the tracks ($t_0$, $t_1$, $t_2$) according to the correlation value of each track T110, calculating sum of the correlation values for each pulse position index of the tracks ($t_0$, $t_1$, $t_2$) T120, checking whether the calculated sum is over the threshold value T130, searching the track 3 ($t_3$) if the calculated sum is over the threshold value T140, checking whether search for all pulse position index compositions of the tracks ($t_0$, $t_1$, $t_2$) is completed after searching the track 3 ($t_3$) T150, increasing the pulse position indexes of the tracks ($t_0$, $t_1$, $t_2$) if the search for all pulse position index compositions of the tracks ($t_0$, $t_1$, $t_2$) is not completed T160, and finishing the fixed codebook search for the corresponding sub-frames if the calculated sum is equal to or less than the threshold value T170.

As shown in the Table 3, the tracks ($t_0$, $t_1$, $t_2$) are searched in an order dependent on a size of d'(n). However, all of 8 position values of each track are not searched, but some position values limited depending on probability are searched. For an example based on Table 4, only 4 position values are searched in the track ($t_0$), only 5 position values are searched in the track ($t_1$) and only 6 position values are searched in the track ($t_2$), while the searching process for other position values having low probability is excluded, so reducing computational complex without loss of the tune quality.

Interactions between the steps are described below with reference the Tables 1, 2, 3 and 4.

The step of determining the correlation values for each pulse position index in the tracks ($t_0$, $t_1$, $t_2$) T100 determines the correlation values for each pulse position index in each track. That is, if the correlation value is d'(n), the step T100 determines sized of d'(0), d'(5), d'(10), . . . , d'(35) for the track 0 ($t_0$), sizes of d'(1), d'(6), d'(11), . . . , l d'(36) for the track 1 ($t_1$), and sizes of d'(2), d'(7), d'(12) . . . , d'(37) for the track 2 ($t_2$).

Table 2 is a chart showing the correlation values for each pulse position index of the tracks ($t_0$, $t_1$, $t_2$) in a specific sub-frame.

The step of arranging the pulse position indexes of the tracks ($t_0$, $t_1$, $t_2$) according to the correlation value of each track T110 involves comparing sizes of correlation values of each pulse position index for each track and then arranging them in a descending order.

In other words, the step T110 compares the correlation value magnitudes obtained for all pulse position indexes of the track 0 ($t_0$) and then arranges the correlation values in a descending order. The step T110 executes an arrangement for the tracks 1 and 2 in a descending order by using the same approach.

Table 3 is a chart showing the process of arranging the pulse position indexes in a descending order according to the correlation value magnitudes of each of the tracks ($t_0$, $t_1$, $t_2$) in a specific sub-frame.

Referring to Tables 2 and 3, Table 2 assumes that the correlation value is given for each pulse position index and Table 3 shows pulse positions (or position indexes) arranged in a descending order on the basis of the correlation value.

Therefore, the pulse position indexes are newly arranged in the tracks ($t_0$, $t_1$, $t_2$), in which the pulse position indexes are arranged as 5, 25 . . . , 30 in the track 0, as 6, 1 . . . , 31 in the track 1, and as 32, 37, . . . , 27 in the track 2.

The step T120 calculates a sum of the correlation values for each pulse position index of the tracks ($t_0$, $t_1$, $t_2$).

Referring to Table 3, the step T120 obtains a sum of the correlation values for each pulse position index |d(5|+|d(6)|+|d(32)|, for each pulse position index composition (5, 6, 32) of the tracks ($t_0$, $t_1$, $t_2$).

In addition, the step of checking whether the calculated sum is over the threshold value T130 performs comparison between the calculation sum of the pulse position index composition and the threshold value previously determined before the fixed codebook search.

The step T140 searches an optimal pulse position in the track 3 for the pulse position index composition if the calculated sum is over the threshold value.

As an example, if the sum of the correlation vector sizes for the pulse position index composition (5, 6, 32) is bigger than the threshold value in Table 3, the search candidates for searching an optimal pulse position in the tracks 0, 1 and 2 become (5, 6, 32, 3), (5, 6, 32, 8), . . . , (5, 6, 32, 39). They are compositions adding each pulse position index of the track 3 shown in FIG. 1 to the pulse position index composition (5, 6, 32).

The step of checking whether search for all pulse position index compositions of the tracks ($t_0$, $t_1$, $t_2$) is completed after searching the track 3 ($t_3$) T150 is to check whether the track 3 is searched for all candidates in the case that the calculated sum is over the threshold value.

The step of increasing the pulse position indexes of the tracks ($t_0$, $t_1$, $t_2$) if the search for all pulse position index compositions of the tracks ($t_0$, $t_1$, $t_2$) is not completed T160 is increasing the pulse position index to obtain the next pulse position index composition for the tracks 0, 1 and 2 in the case that the calculated sum is over the threshold value.

As an example, if the current search candidate is (5, 6, 32) for the tracks 0, 1 and 2, the next search candidate adding the pulse position index may be (5, 6, 37).

If the pulse position index is added one more time, the next search candidate may be (5, 6, 12).

If the calculated sum is equal to or less than the threshold value, the search for the track 3 is not performed but the fixed codebook search for the corresponding sub-frames is finished T170.

Therefore, if there is a candidate not over the threshold value when determining candidates for searching the track 3, other candidates are also not over the threshold value, so stopping the search for the fixed codebook to reduce unnecessary computational complex.

As explained above, Table 4 is a chart showing statistical probabilities that each pulse position for the tracks 0, 1 and 2 is selected as an optimal pulse position for the tracks 0, 1 and 2 is selected as an optimal pulse position. As shown in the table, probability values that each pulse position for the tracks 0, 1 and 2 is selected as an optimal pulse position are arranged sequentially. Their arrangement is identical to that which is arranged in a descending order based on the size of the correlation value for each pulse position index.

This will be well understood with reference to the Formula 8, in which the numerator has more attribution than the denominator because the numerator of the Formula 8 based on the d'(n) value is in a square type.

Therefore, the pulse position, which maximizes the correlation value ($C_k$), is very probable to be the optimal pulse position, while the pulse position having the biggest correlation vector size is most probable to be the optimal pulse position.

According to such method, only limited pulse position values are searched according to the probability, or the size of the correlation value, not searching all of 8 pulse positions of the tracks 0, 1 and 2.

As an example, in Table 4, only 4 pulse positions are searched in the track ($t_0$), only 5 pulse positions are searched in the track ($t_1$) and only 6 pulse positions are searched in the track ($t_2$), while the searching process for other pulse positions having low probability is excluded, so reducing computational complex without loss of the tune quality.

In other word, by using the method of the present invention, better performance is expected in an aspect of the computational complex in the fixed codebook search than the prior art, with same tune quality.

Furthermore, the high-speed fixed codebook search method of the present invention may be applied to the search process for various types of fixed codebook having a logarithmic structure.

TABLE 1

| Track | Pulse | Sign | Pulse Position |
|---|---|---|---|
| $t_0$ | $i_0$ | $S_0$: ± 1 | $m_0$: 0, 5, 10, 15, 20, 25, 30, 35 |
| $t_1$ | $i_0$ | $S_1$: ± 1 | $m_1$: 1, 6, 11, 16, 21, 26, 31, 36 |
| $t_2$ | $i_0$ | $S_2$: ± 1 | $m_2$: 2, 7, 12, 17, 22, 27, 32, 37 |
| $t_3$ | $i_0$ | $S_3$: ± 1 | $m_3$: 3, 8, 13, 18, 23, 28, 33, 38<br>4, 9, 14, 19, 24, 29, 34, 39 |

TABLE 2

| | Correlation Value for each Pulse Position | | | | | | | |
|---|---|---|---|---|---|---|---|---|
| Track | 1 | 2 | 3 | 4 | 5 | 6 | 7 | 8 |
| $t_0$ | 321.46 | 607.41 | 427.43 | 315.35 | 160.85 | 435.74 | 92.08 | 262.93 |
| $t_1$ | 394.46 | 707.68 | 163.61 | 68.24 | 273.52 | 146.57 | 57.10 | 250.15 |
| $t_2$ | 92.74 | 226.62 | 311.25 | 128.03 | 279.58 | 5.06 | 929.33 | 351.56 |

TABLE 3

| Track | Pulse | Sign | Pulse Position |
|---|---|---|---|
| $t_0$ | $i_0$ | $S_0$: ± 1 | $m_0$: 5, 25, 10, 0, 15, 35, 20, 30 |
| $t_1$ | $i_0$ | $S_1$: ± 1 | $m_1$: 6, 1, 21, 37, 11, 26, 16, 31 |
| $t_2$ | $i_0$ | $S_2$: ± 1 | $m_2$: 32, 37, 12, 22, 7, 17, 2, 27 |

TABLE 4

| Track | Probability for each Pulse Position | | | | | | | |
|---|---|---|---|---|---|---|---|---|
| | 1 | 2 | 3 | 4 | 5 | 6 | 7 | 8 |
| $t_0$ | 0.63194 | 0.19104 | 0.08319 | 0.03751 | 0.02712 | 0.01411 | 0.00773 | 0.00432 |
| $t_1$ | 0.59331 | 0.20665 | 0.08967 | 0.04761 | 0.02902 | 0.01708 | 0.01142 | 0.00521 |
| $t_2$ | 0.60419 | 0.19561 | 0.09091 | 0.04770 | 0.02717 | 0.01631 | 0.01162 | 0.00645 |

The present invention gives effects of reducing computational complexity required to search the codebook without signal distortion in quantizing the LSP parameters of the speech encoder using SVQ manner, and reducing computational complexity without loss of tone quality in G.729 fixed codebook search by performing candidate selection and search on the basis for the correlation value size of the pulse position index.

What is claimed is:

1. A high speed search method in a speech encoder using an order character of LSP (Line Spectrum Pair) parameters in an LSP parameter quantizer using SVQ (Split Vector Quantization) used in a low-speed transmission speech encoder, the high-speed search method comprising the steps of:

rearranging a first codebook by replacing the first codebook with a new codebook in which a number of code vectors in the new codebook are arranged in an order according to an element value of a reference row of the first codebook for determining a range of code vectors to be searched; and determining a search range by using an order character between a given target vector and an arranged code vector to obtain an optimal code vector, wherein the rearranging step comprises the steps of:

selecting the reference row in the first codebook by using a plurality of voice data, and then determining an optimal arrangement position (Nm) in which an average search range is minimized; and replacing the first codebook with the new codebook in which a number (Lm) of code vectors in the new codebook are arranged in a descending order according to the element value of a selected said reference row.

2. A high-speed search method in a speech encoder using an order character of LSP (Line Spectrum Pair) parameters in an LSP parameter quantizer using SVQ (Split Vector Quantization) used in a low-speed transmission speech encoder, the high-speed search method comprising the steps of:

rearranging a first codebook by replacing the first codebook with a new codebook in which a number of code vectors in the new codebook are arranged in an order according to an element value of a reference row of the first codebook for determining a range of code vectors to be searched; and determining a search range by using an order character between a given target vector and an arranged code vector to obtain an optimal code vector, wherein obtaining an optimal code vector comprises the steps of:

determining the search range by forward and backward comparison of the element value of the reference row in the first codebook and element values of positions before and after a reference position in the target vector; and obtaining an error criterion ($E_{l,m}$) having high computational complexity by using the following equation only within the determined search range:

$$E_{l,m}=(p_m-p\}_{l,m})^T W_m(P_m-p\}_{l,m})$$

$$0 \leqq m \leqq M-1$$

$$1 \leqq l \leqq L_m$$

where p is an LSP code vector divided into M sub-vectors, each of which consists of $L_m$ code vectors, where $P_m$ is a target vector to search the $m^{th}$ codebook, and $P\}_{l,m}$ corresponds to an $l^{th}$ code vector in a codebook for an $m^{th}$ sub-vector, where l,m in the subscript of $E_{l,m}$ are indices that represent the lth index of the mth codebook, i.e., the letters "l" and "m,"

where superscript T designates the transpose of $(p_m-p\}_{l,m})$ for purposes of determining the dot product of $(p_m-p\}_{l,m})$ and $W_m$ $(p_m-\}_{l,m})$ in order to calculate the least-mean-square error $E_{l,m}$, and where $W_m$ is a weighting matrix for the $m^{th}$ sub-vector and obtained by a non-quantized LSP code vector p.

3. The high-speed search method as claimed in claim 2, wherein the search range is an average number with which an element value of the $n^{th}$ row in the first codebook and element values in the $n+1^{th}$ and $n-1^{th}$ positions of the target vector satisfy the order character.

* * * * *